United States Patent [19]

Szasz et al.

[11] Patent Number: 5,071,154

[45] Date of Patent: Dec. 10, 1991

[54] SKI BOOT/SKI BINDING COMBINATION

[75] Inventors: Tibor Szasz; Jutta Zalud, both of Wien, Austria

[73] Assignee: TMC Corporation, Baar/Zug, Switzerland

[21] Appl. No.: 172,444

[22] Filed: Mar. 24, 1988

[30] Foreign Application Priority Data

Apr. 17, 1987 [AT] Austria ..... 968/87

[51] Int. Cl.[5] ..... A63C 9/081

[52] U.S. Cl. ..... 280/618; 280/625

[58] Field of Search ..... 280/613, 617, 618, 620, 280/625, 633

[56] References Cited

U.S. PATENT DOCUMENTS

| | | | |
|---|---|---|---|
| 3,410,568 | 11/1968 | Wiley | 280/618 |
| 3,665,620 | 5/1972 | St Clair | 36/7.5 |
| 3,918,732 | 11/1975 | Wulf | 280/613 |
| 4,078,322 | 3/1978 | Dalebout | 36/80 |
| 4,245,409 | 1/1981 | Beyl | 36/117 |
| 4,316,618 | 2/1982 | Sampson | 280/613 |

FOREIGN PATENT DOCUMENTS

| | | | |
|---|---|---|---|
| 369242 | 5/1982 | Austria . | |
| 2906242 | 8/1980 | Fed. Rep. of Germany . | |
| 1240519 | 8/1960 | France . | |
| 76161 | 8/1961 | France . | |
| 2850429 | 6/1979 | France | 280/613 |

*Primary Examiner*—Andres Kashnikow
*Assistant Examiner*—Eric Culbreth
*Attorney, Agent, or Firm*—Finnegan, Henderson, Farabow, Garrett & Dunner

[57] ABSTRACT

The invention concerns a ski boot/ski binding combination with an adapter for various sizes of ski boots consisting of a plate-like part and an underside attachment member. The ski boot is removably fastened on to the plate-like part of the adapter. The attachment member serves as the mounting support for the adapter on the ski by means of spring-loaded ski binding parts.

The attachment spans in the longitudinal direction of the adapter plate over a length corresponding to the metatarsus and the front tarsus area of the skier's foot in the ski boot. This provides the skier with support in the major stretching part of his foot when walking with the adapter.

4 Claims, 1 Drawing Sheet

SKI BOOT/SKI BINDING COMBINATION

BACKGROUND OF THE INVENTION

1. Field of the Invention

The present invention relates to a ski boot/ski binding combination with an adapter suitable for use with ski boots of various sizes. The adapter includes an upper plate-like member and an underside attachment member. More particularly, the invention is directed to a combination wherein the ski boot is removably attached to the upper plate-like member of the adapter and the underside attachment member is connected to the ski binding at two fixed parts. The invention further relates to the improved comfort that is attained when walking in the ski boot while it is attached to the adapter. Walking is facilitated by an adapter design that ensures proper support of the foot inside the ski boot.

2. Description of the Prior Art

The design of the ski boot/ski binding combinations have been numerous with each directed to solving a specific problem or to gain a particular advantage when skiing for recreation or competition. However, the prior art has not disclosed a ski boot/ski binding combination with an adapter directed to facilitating walking by providing adequate support for the skier's foot in the ski boot.

A conventional ski boot/ski binding combination is disclosed in U.S. Pat. No. 3,918,732. The adapter and bindings disclosed are generally known as central-point bindings. The ski binding parts and the corresponding counter surfaces, as seen from the side view, are positioned in the central area of the ski boot. In this design, as shown in FIGS. 1 thru 10 of the '732 patent, both ski binding parts are fastened to the surface of the ski and the corresponding counter surfaces are part of an attachment which is fastened to the plate-like part of the adapter. However, as shown in FIG. 5, it can be seen that this attachment is basically disk shaped and therefore unsuitable for walking even for short distances. Additionally, the design presents the problem of these connection points being clogged up with snow, ice, etc. For this reason it is necessary after a fall to unbuckle the ski boot and clean the connecting surfaces of the binding parts and the attachment. Either the ski boot has to be fastened again to the plate-like part and then fastened to the binding, or the plate-like part has to be first set into the binding and then the ski boot fastened to the plate-like part manually. All of the above manipulations are difficult in cold weather and on iced over slopes.

U.S. Pat. No. 4,316,618 discloses the use of two balls as attachment means at the underside of the plate-like part for connection with fixed ski binding parts. For walking even short distances, the ski boot must be unbuckled from the plate-like part and buckled again for skiing. Therefore, the disadvantageous manipulations, as described in U.S. Pat. No. 3,918,732, are increased with this design.

The solution specified in the French Patent of Addition No. 76 161 to the U.S. Pat. No. 1,240,519 distinguishes itself in style from the prior art. It provides two front and two rear holding devices which are adjustable to the width and thickness of the ski boot and therefore ensure binding of the heel. This provides a ski binding which can be fitted individually for each skier. However, trouble-free walking cannot be guaranteed with this ski boot design because the installed attachment ends in front of the heel.

German Patent No. DE-OS 29 06 242 provides a so-called central point binding type design. It is not very suitable for walking because of the contact surfaces shaped by ball molding.

U.S. Pat. No. 4,078,322 describes an adapter which is designed to benefit skiers whose build deviates from normal anatomy. The contact surface of the ski boot is swung to either side opposed to the ski surface at an angle of 1° to 5° on the axle running in the direction of the ski.

In Austrian Patent No. 369,242, a ski boot is disclosed which has a central part which has the same length for all shoe sizes. The central part projects downward and is held by a front and rear binding device. This design, however, has a disadvantage in that the sizing of the central part must be based on the smallest boot size. With larger boot sizes, the heel and foot pads extend far beyond the central part which makes walking in these boots difficult.

SUMMARY OF THE INVENTION

The present invention of a ski boot/ski binding combination overcomes the problems and disadvantages of the prior art by facilitating walking in the boot and by eliminating the above mentioned manipulation disadvantages after a fall.

To achieve the objects and in accordance with the purpose of the invention, as embodied and broadly described herein, the combination invention comprises a ski boot and ski binding having a first and second fixed part and an adapter means including an upper plate-like member having an upper surface to accept the ski boot and an underside attachment member centrally positioned under the plate-like member. The underside attachment has contact areas which allow connection to said first and second fixed parts of the ski binding, and fastening means, provided adjacent to the upper surface of the plate-like member, for holding the ski boot to the plate-like member. The fastening means are adjustable in the longitudinal direction of the plate-like member and adaptable to be lockably fixed in a boot-holding position for manipulation to allow the ski boot to be attached to or released from the plate-like member. The underside attachment member extends at least beneath the metatarsus and the front tarsus of a foot within the ski boot, wherein the length of the underside attachment member at least corresponds with the metatarsus and the front tarsus of the foot to provide support for the foot.

Walking with the ski boot connected to the plate-like part is comfortable, even with different sizes of boots, because the attachment will at least support the entire metatarsus and front part of the tarsus of the skier's foot. For walking long distances, the ski boot can be released and connected again later for the next downhill run. This is especially advantageous for ski rentals since more comfort can be offered as compared with the conventional solutions.

Additional objects and advantages of the invention will be will be obvious from the description, or may be learned by practice of the invention. The objects and advantages of the invention will be realized and attained by means of the elements and combinations particularly pointed out in the appended claims.

DESCRIPTION OF THE PREFERRED EMBODIMENTS

Figure 1:
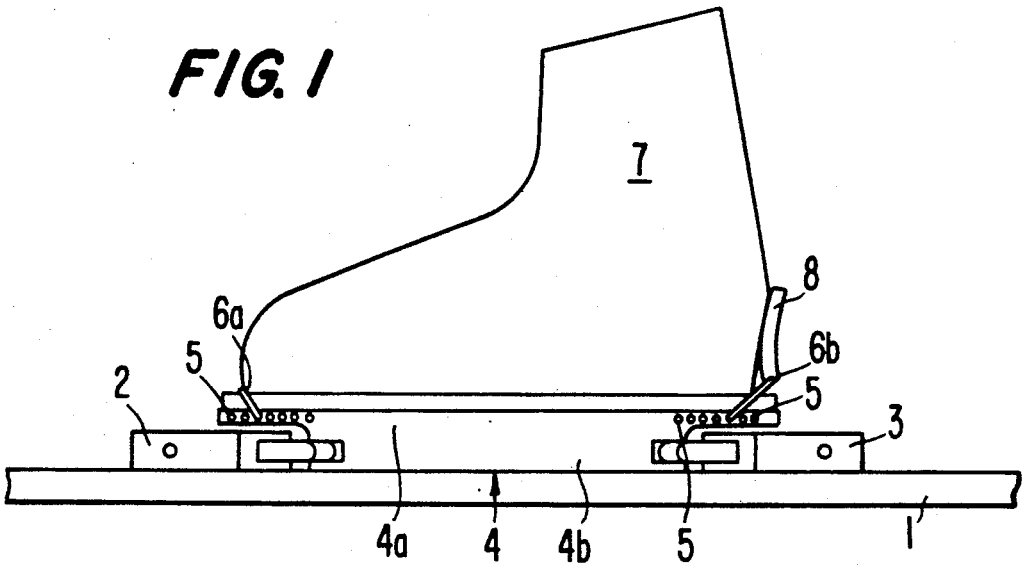
FIG. 1 is a side view of a ski boot/ski binding combination illustrating a first embodiment of the invention.

FIG. 1 shows a ski 1 with two ski binding parts 2 and 3 attached thereto. These ski binding parts 2 and 3 are provided with a known release mechanism which opens when the skier falls. An adapter 4 is clamped tightly between the two binding parts 2 and 3. The adapter consists of a plate-like part 4*a* which serves as support for the sole of the boot 7 and a downward pointing underside attachment 4*b* connecting with part 4*a* for the installation of binding parts 2 and 3. A row of drill holes 5 is recessed on both sides at the end of upper part 4*a* of the adapter 4. In relation to the vertical length median plane of the adapter 4, the drill holes are situated opposite each other forming pairs. Wire clamp straps 6*a* and 6*b* are hooked into one of the drill hole pairs 5 at each end of the adapter 4 to hold the tip and/or heel of the ski boot 7. In accordance with prior art mechanisms for releasing the ski boot 7, the rear wire strap 6*b* is provided with a conventional tensioning lever 8 with one end of the lever placed on the ski boot 7 and the other end of the lever for operation.

Figure 2:
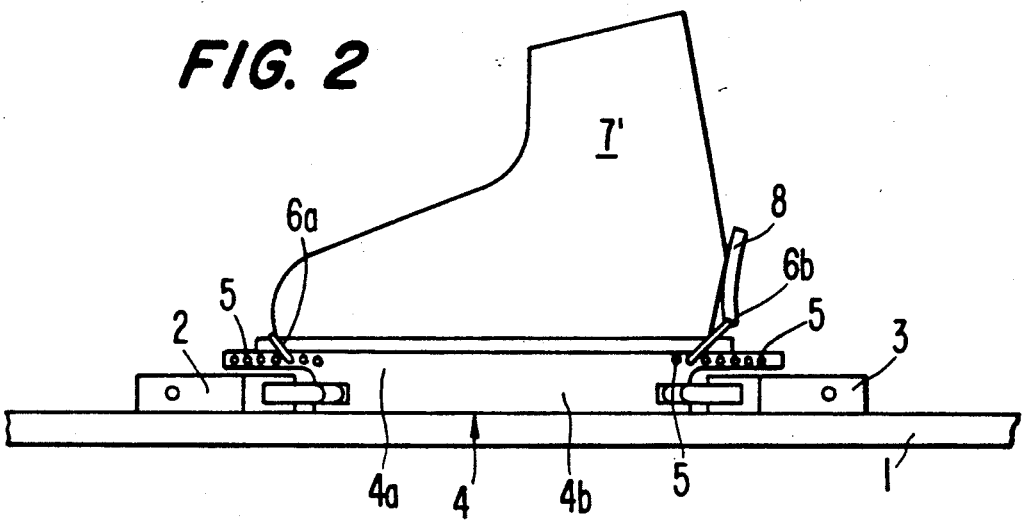
FIG. 2 is a side view of a different size ski boot in the combination of the first embodiment of the invention.

FIG. 2 shows an embodiment of the invention wherein a ski boot 7′ is used in the combination. The wire straps 6*a* and 6*b* are hooked into different drill hole pairs 5 from that shown in FIG. 1. Ski boot 7′ varies in size from ski boot 7 shown in FIG. 1. FIG. 2 also indicates that the length of the attachment 4*a* makes up approximately 90% of the length of the ski boot 7′. Even for various ski boot sizes, this guarantees secure support of at least the metatarsus and the front part of the tarsus and thereby comfortable and safe walking with the ski boot 7 and/or 7′ attached to the plate-like part 4*a* can be achieved.

Skis 1 in a ski rental storage area can be prepared by installing the adapters 4 and then sorting them according to various ski boot sizes. In this case, the customer only needs to fasten his ski boot, for example 7 or 7′ as shown in FIGS. 1 and 2, to the top of part 4*a* with both wire straps 6. Adjustment of ski binding parts 2 and 3 is not necessary. If each customer owns an adapter 4, he can rent skis 1 with uniform adjustment of ski binding parts 2 and 3.

Figure 3:
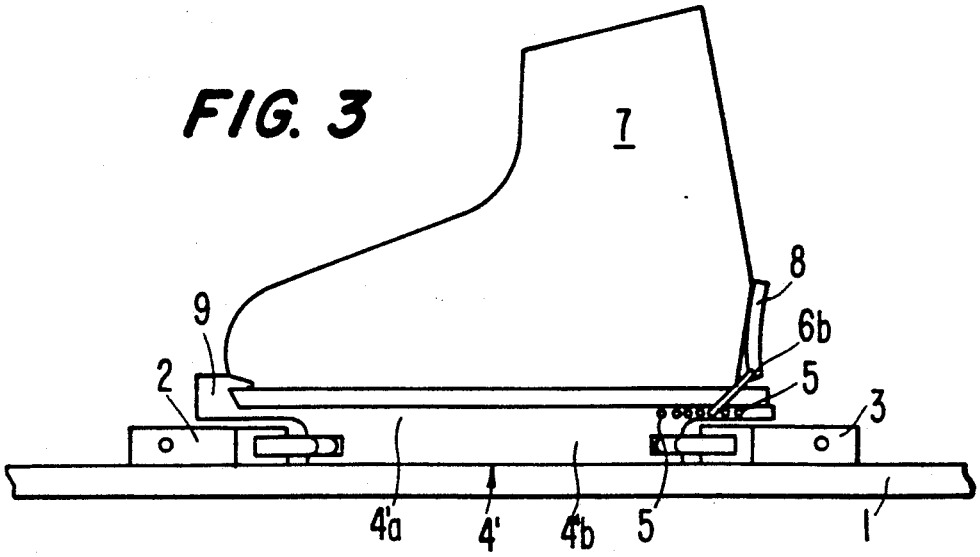
FIG. 3 is a side view of a second embodiment of the invention.

The embodiment shown in FIG. 3 differs from the first embodiment shown in FIGS. 1 and 2 in that the tip of the ski boot is held by a press pad 9 instead of a front wire clamp. At the heel, however, the ski boot 7 is held by a wire clamp 6*b* just as in the first embodiment. To simplify construction, the press pad 9 and the adapter 4′ should be built as one piece.

If the skier intentionally wants to remove his boot 7 or 7′ from the ski 1, he steps out of the existing safety binding parts 2 and 3 in the conventional way. However, if he wants to detach the adapter 4 or 4′ from the ski boot 7 or 7′, he must open the tensioning lever 8 and remove the ski boot 7 or 7′ from both wire clamps 6*a* and 6*b* or from the press pad 9 and the wire clamp 6*b*.

When the skier falls, at least one of the two ski binding parts 2 and 3 will open, whereupon the skier with his ski boots 7 or 7′ and the adapter 4 or 4′ will leave the ski 1. As previously discussed, this equipment enables the skier to walk relatively comfortably. If necessary, especially for longer distances, he can remove the adapter 4 or 4′ and fully utilize the walking comfort of the respective ski boot.

It will be apparent to those skilled in the art that various modifications and variations can be made in the ski boot/ski binding combination of the present invention and in construction of the adapter without departing from the scope or spirit of the invention.

We claim:

1. A combination comprising:

a ski boot;

a ski binding having a first and a second fixed part;

adapter means for holding the ski boot in the ski binding, the adapter means including an upper plate-like member having an upper surface to accept the ski boot and an underside attachment member centrally positioned under the upper plate-like member, said underside attachment member having contact areas which allow connection to said first and second fixed parts of the ski binding; and fastening means, providing adjacent the upper surface of the upper plate-like member, for holding the ski boot to the upper plate-like member, said fastening means being adjustable in the longitudinal direction of the upper plate-like member and adaptable to be lockably fixed in a boot-holding position, said fastening means being manipulated to allow the ski boot to be attached to or released from the upper plate-like member;

wherein the underside attachment member extends at least beneath the metatarsus and the front tarsus of a foot within the ski boot.

2. The combination of claim 1, wherein the length of said underside attachment member is equal to about 90% of the length of said ski boot.

3. The combination of claim 1, wherein said fastening means comprises a first and second fastening means for holding the ski boot to the plate-like member, said first fastening means comprising a press pad formed as a single unit with the plate-like member and acting to hold a toe of the ski boot, and said second fastening means comprising a wire clamp that acts to hold a heel of the ski boot to the adapter means.

4. The combination of claim 1, wherein said fastening means comprises a tension lever.

* * * * *